US007389957B1

(12) United States Patent
Struksnes

(10) Patent No.: US 7,389,957 B1
(45) Date of Patent: Jun. 24, 2008

(54) APPARATUS FOR THE APPLICATION OF ROLLED STABILIZATION FABRIC

(76) Inventor: Harold Struksnes, 5405 33rd Ave. SE., Minot, ND (US) 58701

( * ) Notice: Subject to any disclaimer, the term of this patent is extended or adjusted under 35 U.S.C. 154(b) by 0 days.

(21) Appl. No.: 10/866,605

(22) Filed: Jun. 10, 2004

(51) Int. Cl.
*B65H 75/40* (2006.01)

(52) U.S. Cl. ..... 242/403; 242/557; 242/553.8

(58) Field of Classification Search ..... 242/557, 242/403, 533.8; 414/911
See application file for complete search history.

(56) References Cited

U.S. PATENT DOCUMENTS

| | | | | |
|---|---|---|---|---|
| 2,611,498 | A | 9/1952 | Broersma | 214/115 |
| 3,913,854 | A | 10/1975 | McClure | 242/75.4 |
| 4,160,620 | A * | 7/1979 | Farmer et al. | 414/621 |
| 4,161,253 | A * | 7/1979 | Ralston et al. | 414/24.6 |
| 4,227,850 | A * | 10/1980 | Farmer et al. | 414/620 |
| 4,456,399 | A | 6/1984 | Conover | 404/100 |
| 4,705,229 | A | 11/1987 | Barazone | 242/86.52 |
| 4,930,718 | A | 6/1990 | Lancour et al. | 242/86.5 |
| 5,553,807 | A * | 9/1996 | Lopez | 242/557 |
| 5,806,779 | A | 9/1998 | Crum | 242/399.1 |
| 6,264,400 | B1 | 7/2001 | Gent | 405/129.75 |
| 6,575,393 | B1 | 6/2003 | James, Jr. | 242/390 |
| 2004/0227031 | A1 * | 11/2004 | Yoder et al. | 242/390.5 |

* cited by examiner

*Primary Examiner*—Sang Kim

(57) ABSTRACT

This stabilization fabric application apparatus provides a rectangular framed box constructed of vertical and horizontal frame members. This rectangular box is constructed in a manner so that it is composed of two halves divided vertically through the center of the long axis of the box. These halves are then pivotally joined at the center of the upper surface of the frame at the frame pivot joints. Conversely, the lower surface of the frame is defined by the roller arms which are not connected to one another. This configuration allows the frame to open and close in a clam-like. The roller arms are used to dispense stabilization fabric from a roll contained in the framed box.

19 Claims, 5 Drawing Sheets

FIG 9
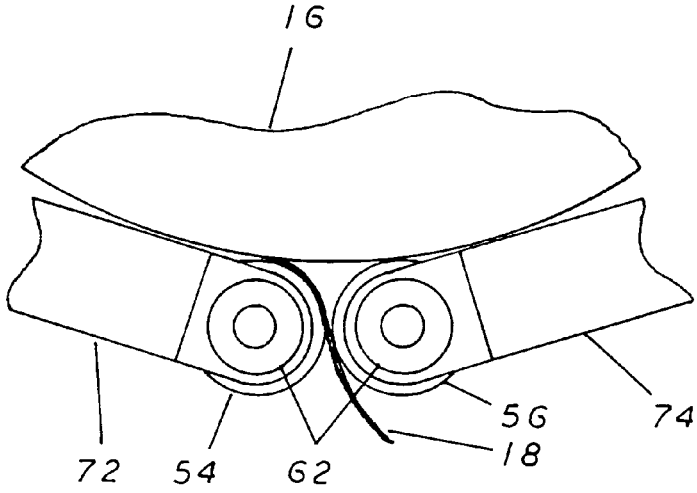
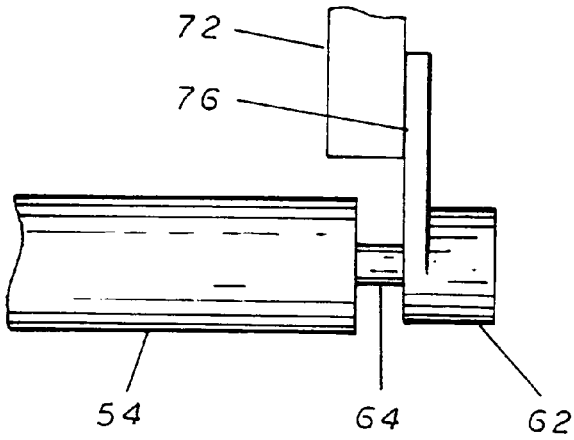
FIG 10

APPARATUS FOR THE APPLICATION OF ROLLED STABILIZATION FABRIC

BACKGROUND OF THE INVENTION

The present invention relates to an improvement in the manner in which construction fabric is applied beneath road beds and other similar construction projects during the initial stages of construction. More specifically, to an apparatus that has been purposely designed to deploy construction fabric in these projects in a highly effective manner that can be accomplished by one person.

The use of fabrics in the construction of roads, airport runways, lagoons, landfills, and all other similar construction projects has become very common in recent years and is in some cases mandated by law. These construction fabrics commonly come in two different types. The first of these is referred to as stabilization fabric and the second is referred to as a non-permeable linear membrane both of which are composed of strands of polyester or nylon that have been woven together to form large ribbons of the stabilization fabric. The ribbons of the fabric are then rolled on to cylindrical cores to form large rolls which are convenient both for storage and for the application of the stabilization fabric at a job site.

The stabilization fabric is commonly employed in the construction of roadways, airport runways, and other similar structures. In the construction of these structures, the stabilization fabric is positioned between the underlying earth and a layer of course aggregate that is commonly used to for a roadbed or runway bed. The use of the stabilization fabric operates to distribute the downward forces of the roadway and the traffic it carries in a more lateral fashion and thereby, over a wider area. This method of construction results in a stronger structure that lasts longer and requires less maintenance over its lifetime.

In the case of the construction of lagoons and landfills, their lining with the non-permeable linear membrane prevents the contents of these structures from leaching and entering the ground water. This is critical for the proper operation of these structures as they often contain pollutants that can cause long term damage that can take years to clean up, if possible at all, and cost millions of dollars. In either case, these construction fabrics are stored and deployed in the same manner and for purposes of simplicity the following description will focus solely on the manner by which the present invention is used to deploy stabilization fabric.

There are some problems associated with the use of stabilization fabric in the construction of these structures, most of which stem from the methods and devices employed to deploy and position it properly. In the past, the application of the fabric at the job site was accomplished in one of two ways. The first of these was simply to do it by hand. To accomplish this, a number of construction workers would manually lift a roll of the stabilization fabric and place it in the desired location with the tongue, or the lose end of the fabric in relation to the roll, positioned over the ground. Once this has been accomplished, the construction workers deployed the fabric by unrolling the fabric roll over the desired section of ground. There are many problems associated with the application of the stabilization fabric by hand not the least of which is the fabric rolls are large and heavy making them difficult to position correctly and requires a relatively large number of workers to accomplish. Additionally, the stabilization fabric is the most effective when it is laid out in a taut manner limiting the amount of wrinkles and creases formed in it during the process. This is very difficult to accomplish by hand as it requires that a good deal of tension be placed on the fabric as it is deployed over the ground. Finally, the presence of wind can also be a problem when deploying the stabilization fabric as it tends to get underneath the fabric and move it from the desired location. This is especially problematic when deploying the fabric by hand as there is no mechanism or method by which to deal with this circumstance and the rolls are too heavy to allow for their manipulation by hand.

The second method commonly employed to deploy stabilization fabric at a job site is the use of machinery to handle and control the fabric rolls during construction. This is most commonly accomplished by the use of an apparatus that has been designed to grasp a fabric roll on either end in a manner that allows it to freely rotate. This allows the fabric to be unwound from the fabric roll so that it can be deployed at the job site. These apparatuses also have the added advantage of being capable of moving the large fabric rolls around the job site thereby lessening the amount of construction workers otherwise required to perform these tasks.

While the use of these apparatuses has both improved the efficiency of employing stabilization fabric and made it significantly easier, problems still exist. These problems are generally the same as some of the ones described for the hand deployed method above. Wind can still get under the fabric as it is being deployed and cause it to be displaced in a manner that interferes with its proper operation. Additionally, wrinkles and creases can also form in the deployed stabilization fabric because these apparatuses do not provide a mechanism by which the proper amount of tension can be placed on the fabric during deployment. Thus, the use of these apparatuses does not eliminate the need for employing multiple workers to complete this task as there is no mechanism that adequately eliminates the wrinkles and creases from the stabilization fabric. This is important to the longevity of the structure being built as the wrinkles and creases can and often do result in damage to the stabilization fabric which limits its effectiveness in performing the job for which it was designed and installed.

Therefore, it can be seen that it would be desirable to provide an apparatus for the deployment of stabilization fabric under road beds and other similar structures in a manner that requires only one worker to complete in a timely and effective manner. Additionally, it can be seen that it would be desirable to provide an apparatus for the deployment of stabilization fabric in a manner that would be entirely unaffected by the presence of wind. Finally, it can also be seen that it would be desirable to provide such an apparatus that contains a mechanism which places a large degree of tension on the fabric during its deployment which effectively eliminates the formation of wrinkles and creases in it which in turn enhances the effectiveness of the fabric while increasing its life span.

SUMMARY OF THE INVENTION

It is the primary objective of the present invention to provide an apparatus for the deployment of stabilization fabric under road beds and other similar structures in a manner that requires only one worker to complete in a timely and effective manner.

It is an additional objective of the present invention to provide such an apparatus for the deployment of stabilization fabric in a manner that would be entirely unaffected by the presence of wind.

It is a further objective of the present invention to provide such an apparatus that contains a mechanism which places a large degree of tension on the fabric during its deployment which effectively eliminates the formation of wrinkles and creases in it which in turn enhances the effectiveness of the fabric while increasing its life span.

These objectives are accomplished by the use of a rectangular box apparatus being constructed of vertical and horizontal frame members. This rectangular box is constructed in a manner so that it is composed of two roughly equal halves divided vertically through the center of the long axis of the box. These halves are then pivotally joined at the center of the upper surface of the frame at the frame pivot joints. Conversely, the lower surface of the frame is defined by the roller arms which are not connected to one another. This configuration allows the frame of the present invention to open in a clam-like fashion wherein the lower surface of the frame opens while the frame halves pivot around the frame pivots located at the central point of the upper surface.

The rectangular box that makes up the present invention is deigned, as illustrated, to be employed in conjunction with a commonly used skid steer loader. However, it is important to note that it is capable of being adapted for use with any number of construction vehicles without significantly altering its construction or manner of operation. The connection of the present invention to the skid steer loader is facilitated by the frame mount located on the vertical surface of the rear frame. The design of the frame mount is such that it fits easily onto the standard skid steer type mount without the need for the modification of either unit. Additionally, the present invention also employs hydraulic components which are designed to connect directly to the hydraulic system of the skid steer loader. This is accomplished by connecting the present invention's hydraulics to the skid steer through the use of a hydraulic pressure line and a hydraulic return line. This method of design provides the present invention with hydraulic power without the necessity of having a separate hydraulic power source thereby lessening its cost and increasing its versatility.

The hydraulic power supplied to the present invention as described above is employed to operate its hydraulic cylinder assembly. The hydraulic cylinder assembly is the component of the present invention which is used to open and close the frame which in turn allows it to pick up stabilization fabric rolls and to deploy the fabric in the desired location and manner. The hydraulic cylinder assembly is composed primarily by the hydraulic cylinder which is mounted on the center of the upper surface of the frame in a manner so that it spans the pivotal connection between the rear and front frame halves. The connection of the hydraulic cylinder is accomplished at its rearward end by its pivotal attachment to the rear mount extending upwards from the upper surface of the rear frame. The forward end of the hydraulic cylinder is then pivotally attached to the front mount which in turn extends upwards from the upper surface of the front frame. The pivotal mounting of the hydraulic cylinder allows these components to alter their positions relative to one another which is an important characteristic of the present invention.

The hydraulic cylinder is employed to open the frame of the present invention which is accomplished by its positioning and method of attachment as described above. To operate this system, the hydraulic cylinder is contracted by the operator of the skid steer. The contraction of the hydraulic cylinder serves to draw the front mount towards the rear mount which in turn rotates the front frame upwards around its pivotal connection to the rear frame. This serves to open up the lower surface of the frame by creating space between the front and rear roller arms. With the front and rear roller arms thus opened, the frame can be positioned over fabric rolls. The front and rear roller arms are then closed by expanding the hydraulic cylinder which forces the front mount away from the rear mount thereby closing the opening between the front and rear roller arms. This allows the operator of the skid steer loader to engage and transport the large fabric rolls without requiring the assistance of other workers. Additionally, this also provides the operator with the ability to position the fabric roll within the present invention so that it can be easily deployed in the desired location.

To facilitate the lifting and transport process described above, the inwards extremities of the front and rear roller arms serve as the points of attachment for the rear and front feeder rollers. The rear and front feeder rollers extend through the center of the frame and each define the inside lower edge of the rear and front frames. The rear and front feed rollers are pivotally attached to the rear and front roller arms respectively. This allows them to freely rotate within the frame of the present invention at all times. This capability is important to operation of the present invention as it allows a fabric roll contained within the frame to rotate which in turn allows the fabric to be dispensed as desired.

In the grasping and lifting of a fabric roll, a short section of the fabric must be separated from its body. This short section, or tongue, becomes pinched between the rear and front feeder rolls. This positioning of the fabric between the rear and front feeder rollers allows it to be evenly fed out of the present invention as needed to cover the ground as required. Additionally, the design of the hydraulic assembly and feeder rollers allow the operator to place tension of the fabric being deployed. This is important in that a proper degree of tension on the fabric as it is being deployed inhibits the formation of wrinkles and creases in the fabric that can impair its function and its useful life span. The required tension is produced by applying closing force on the feeder rollers by the implantation of expansion force from the hydraulic cylinder. This serves to pinch the fabric between the feeder rollers which in turn slows the rate at which it can be deployed from the present invention. The reduced rate of deployment of the fabric can be exploited to stretch or tension the fabric which in turn eliminates all wrinkles and creases from the fabric in its deployed state. Thus, the present invention provides a means by which stabilization fabric can be deployed at a job site by a single worker in a manner that will both increase its effectiveness and life span.

For a better understanding of the present invention reference should be made to the drawings and the description in which there are illustrated and described preferred embodiments of the present invention.

DESCRIPTION OF THE DRAWINGS

FIG. 9 is a close-up side elevation view of the feeder roller components of the present invention illustrating the manner in which they are employed to control the rate of fabric deployment.

FIG. 10 is a close-up front elevation view of the feeder roll components of FIG. 9 further illustrating the manner by which they are pivotally attached to the frame of the present invention.

DESCRIPTION OF THE PREFERRED EMBODIMENT

Figure 1:
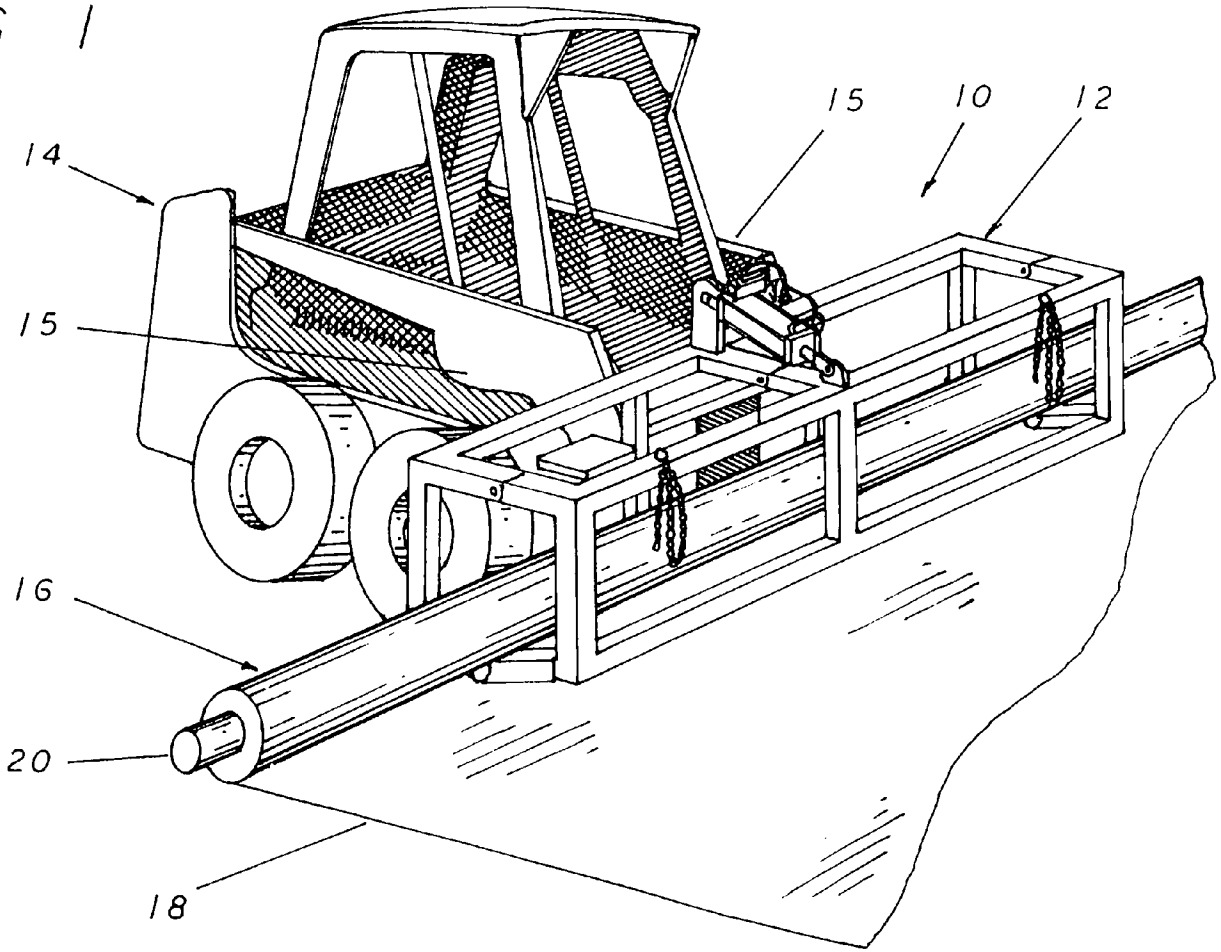
FIG. 1 is a perspective view of the present invention which illustrates its general manner of construction, the way it engages and deploys a fabric roll, and the manner by which a skid steer loader is employed to operate it.
Figure 2:
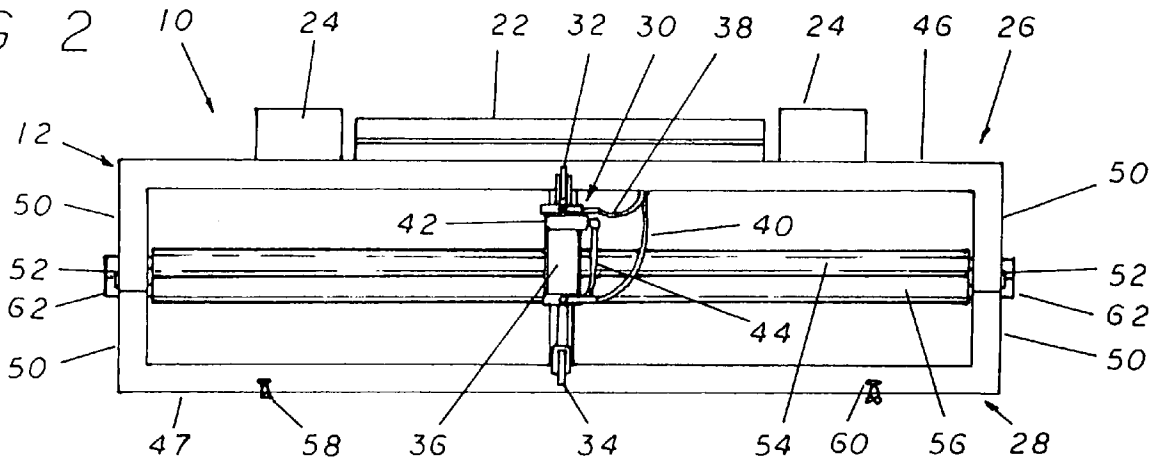
FIG. 2 is a top elevation view of the present invention illustrating its general configuration and the orientation of the hydraulic assembly.
Figure 3:
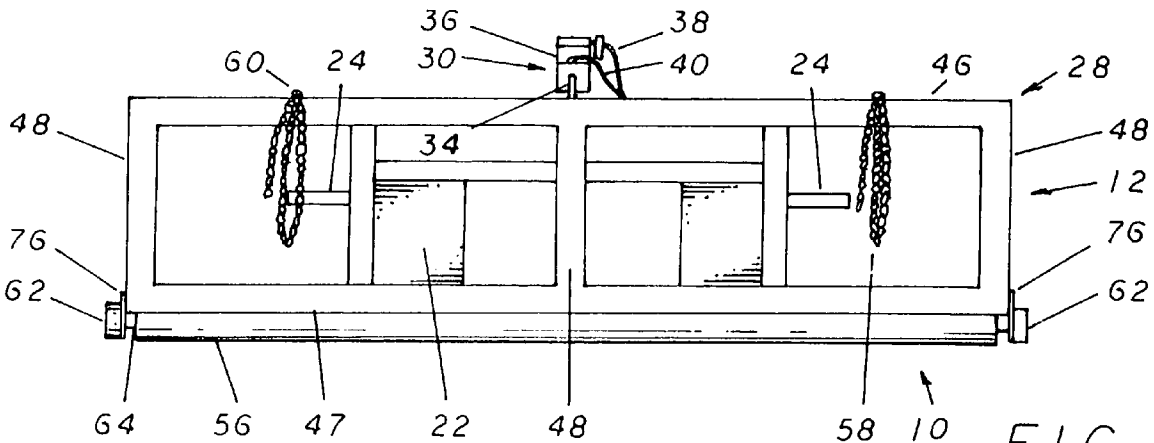
FIG. 3 is a front elevation view of the present invention of FIG. 2 and further illustrating the orientation of the two feeder rollers.
Figure 4:
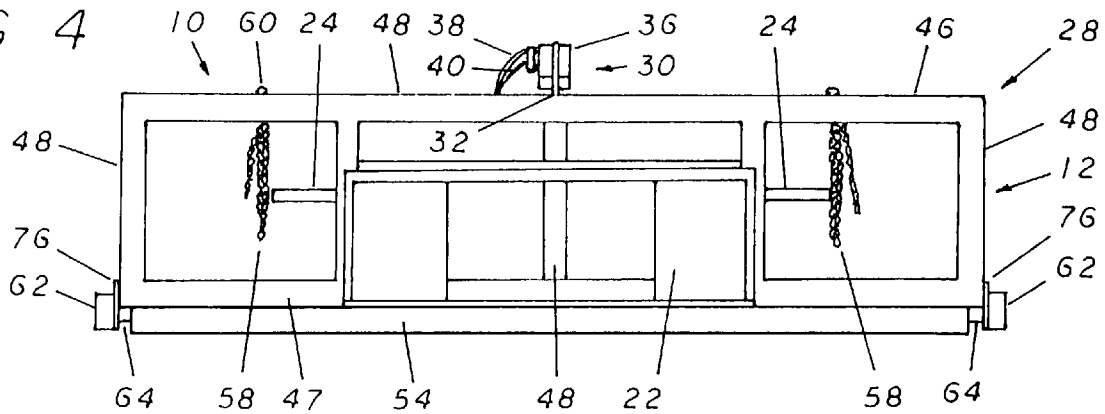
FIG. 4 is a rear elevation view of the present invention of FIG. 2 and further illustrating the location and configuration of the frame mount.

Referring now to the drawings, and more specifically to FIGS. 1, 2, 3, 4, and 5, the stabilization fabric application apparatus 10 is an opened framed box-like apparatus designed to be used in conjunction with construction equipment such as a skid steer loader 14. For this purpose, the present invention is equipped with a frame mount 22 positioned on its most rearward vertical surface as detailed in FIG. 4. The frame mount 22 is designed to accept the standard ancillary tool mounts commonly fitted to the outer most ends of the skid steer loader's 14 manipulation arms 15. The use of the frame mount 22 allows the present invention to be quickly and easily fitted to the skid steer loader 14 providing it with a greater degree of flexibility as it can be employed in other tasks when the present invention is not being used. Additionally, it must be noted that the present invention is capable of being adapted for use with any number of construction vehicles but it is being illustrated herein as exclusively being used in conjunction with a ski steer loader 14 for the purposes of simplicity.

The frame 12 of the present invention is generally an opened framed rectangular box being made up of a rear frame half 26 and a front frame half 28. The rear frame half 26 is that portion of the frame 12 positioned towards the skid steer loader 14 and serves as the mounting point for the frame mount 22. The rear frame half 26 is made up of an upper horizontal frame member 46 and a lower horizontal frame member 47 defining the length of the frame 12 and vertical frame members 48 defining its height. The inner corners and inner center point of the upper horizontal frame member 46 associated with the rear frame half 26 are the mounting points for the frame pivot arms 50 associated with the rear frame half 26. These frame pivot arms 50 extend forwards form these points and terminate at the frame pivots 52. The frame pivots 52 connect to the frame pivot arms 50 associated with the front frame half 28 and this configuration defines the upper surface of the frame 12 and its overall depth. Finally, the inner corners of the lower horizontal frame member 47 associated with the rear frame half 26 are the mounting points for the rear roller arms 72. The rear roller arms 72 are mounted so that they extend forwards at a slightly downward diagonal, the purpose of which will be described below. The inner most end of the rear roller arms 72 serves as the mounting point for the rear feeder roller 54. The rear feeder roller 54 defines the lower inside edge of the rear frame half 26 and its operational function being critical to the purpose of the present invention will be described in greater detail below.

The front frame half 28 is that portion of the frame 12 that is positioned away from the skid steer loader 14. The front frame half 28 is made up of an upper horizontal frame member 46 a lower horizontal frame member 47 defining the length of the frame 12 and vertical frame members 48 defining its height. The front frame half 28 is made up of an upper horizontal frame member 46 and a lower horizontal frame member 47 defining the length of the frame 12 and vertical frame members 48 defining its height. The inner corners and inner center point of the upper horizontal frame member 46 associated with the front frame half 28 are the mounting points for the frame pivot arms 50 associated with the front frame half 28. These frame pivot arms 50 extend rearwards form these points and terminate at the frame pivots 52. The frame pivots 52 connect to the frame pivot arms 50 associated with the rear frame half 26 and this configuration defines the upper surface of the frame 12 and its overall depth. Finally, the inner corners of the lower horizontal frame member 47 associated with the front frame half 28 are the mounting points for the front roller arms 74. The front roller arms 74 are mounted so that they extend rearwards at a slightly downward diagonal, the purpose of which will be described below. The inner most end of the front roller arms 74 serves as the mounting point for the front feeder roller 56. The front feeder roller 56 defines the lower inside edge of the front frame half 28 and its operational function being critical to the purpose of the present invention will be described in greater detail below.

A pivotal connection between the rear frame half 26 and the front frame half 28 is made at the frame pivots 52 between the frame pivot arms 50 associated with the rear frame half 26 and those associated with the front frame half 28. The use of the frame pivot arms 50 to make this connection allows the rear frame half 26 and the front frame half 28 to pivot with respect to one another around this connection. This pivoting capability provides the mechanism by which an opening can be created between the rear feeder roller 54 and the front feeder roller 56. This allows the present invention to pick up and hold fabric rolls 16 as illustrated in FIG. 1. A fabric roll 16 is made up of stabilization fabric 18 wound tightly around a centrally located cylindrical core 20 and is the common form in which it is stored and deployed.

Figure 5:
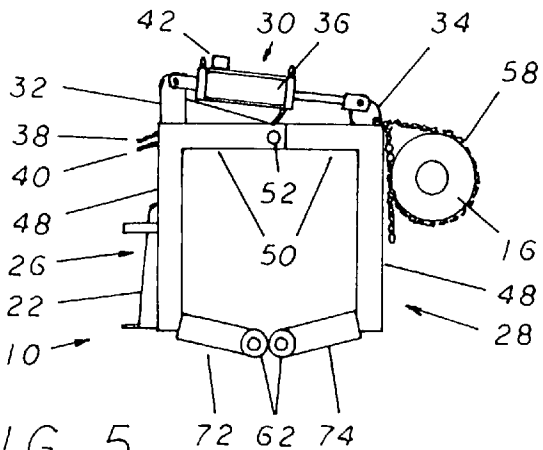
FIG. 5 is a side elevation view of the present invention of FIG. 2 further illustrating the use of the accessory chains and the manner by which they are used to carry additional stabilization fabric rolls.

The present invention also incorporates ancillary features that are associated with the frame 12. The first of these are the safety steps 24. The safety steps 24 extend rearward from the vertical frame members 48 of the rear frame half 26 on either side of the frame mount 22. The safety steps 24 provide a surface upon which the operator of the present invention can step to gain access to the interior of the upper area of the frame 12. An additional feature is the accessory chains 58 which are mounted to the upper horizontal frame members 46 associated with the front frame half 28. The mounting is accomplished by the use of a pair of accessory chain mounts 60. The accessory chains 58 provide a means by which the present invention can carry additional fabric rolls 16 (as illustrated in FIG. 5) for transportation purposes or to lessen the down time when changing fabric roll 16.

Figure 6:
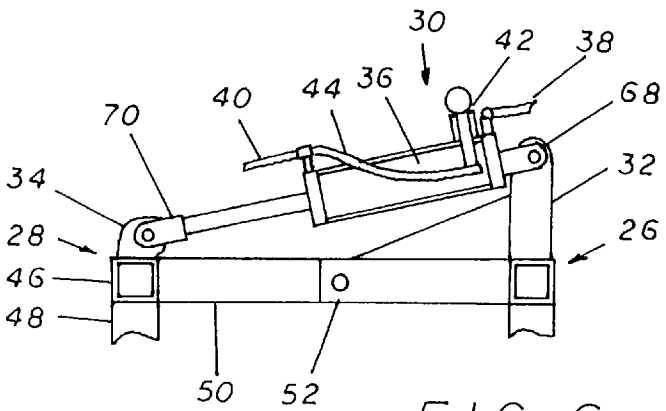
FIG. 6 is a side elevation view of the hydraulic assembly component of the present invention illustrating its manner of construction and its pivotal attachments to the upper surface of the invention's frame.

The opening and closing of the frame 12 as described above is controlled through the operation of the hydraulic assembly 30 positioned centrally on the upper surface of the frame 12 in a manner that spans the central frame pivot 52 between the rear frame half 26 and the front frame half 28. The manner of construction of the hydraulic assembly 30 and its manner of attachment to the other components of the present invention is further detailed in FIG. 6. The primary component of the hydraulic assembly 30 is the hydraulic cylinder 36 which provides the opening and closing power that is central to this component of the present invention. The hydraulic cylinder 36 is pivotally attached at its rearward end to the rear frame half 26 at the rear mount 32 by the use of the rear cylinder mount 68. The rear mount 32 is a flat tab that extends upwardly from the upper horizontal frame member 46 at its central point. The hydraulic cylinder 36 extends forward from this point of attachment to the point at which its most forward end pivotally attaches to the front mount 34 by the use of the front cylinder mount 70. The front mount 34 is another flat tab, although considerably shorter than the rear mount 32, extending upwards from the upper horizontal frame member 46 associated with the front frame half 28. This method of pivotally attaching the hydraulic cylinder 36 and the relative differences in height between the rear and front mounts, 32 and 34, ensures that the operation of the hydraulic cylinder 36 will provide the power necessary to open and close the frame 12 as is required by the intended operation of the present invention.

The hydraulic power that is necessary to operate the hydraulic assembly 30 is obtained through a connection with the hydraulic system of the skid steer loader 14. This is accomplished by the use of a hydraulic pressure line 38 and a hydraulic return line 40 which are connected to the skid steer 14 on one end and the hydraulic cylinder 36 on the other. This connection allows the operator from his seat within the skid steer loader 14 to expand the hydraulic cylinder 36 by applying hydraulic pressure or to contract it by releasing the hydraulic pressure. Additionally, the hydraulic cylinder 36 is also equipped with a pressure relief valve 42 and a pressure relief line 44. The presence of the pressure relief valve 42 and the pressure relief line 44 is critical to the operation of the present invention and as such, will be discussed in greater detail below.

Figure 7:
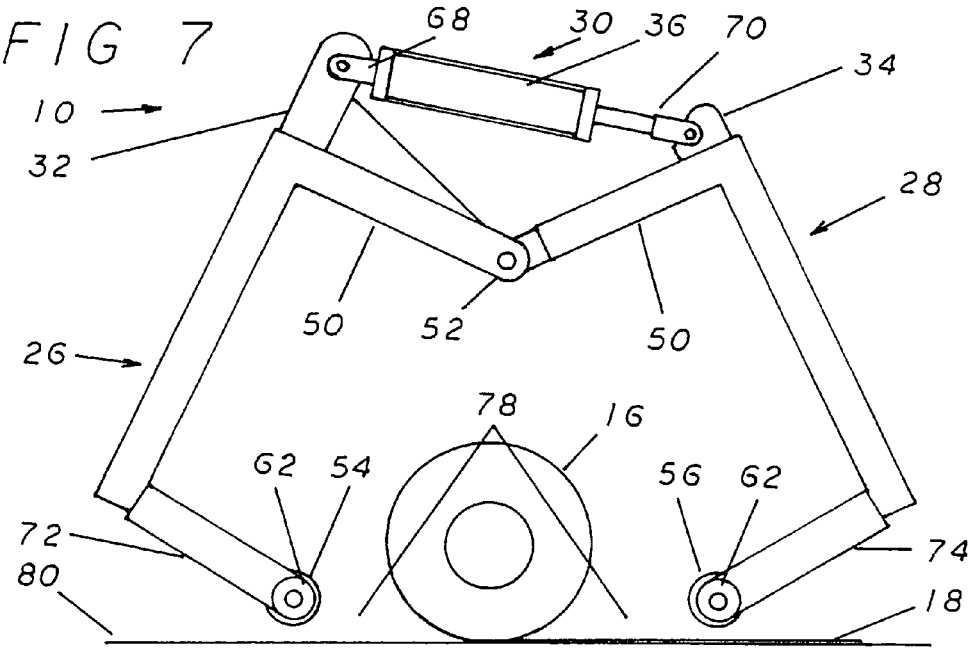
FIG. 7 is a side elevation view of the present invention of FIG. 2 further illustrating the manner by which its frame is opened by the action of the hydraulic assembly to receive a fabric roll.
Figure 8:
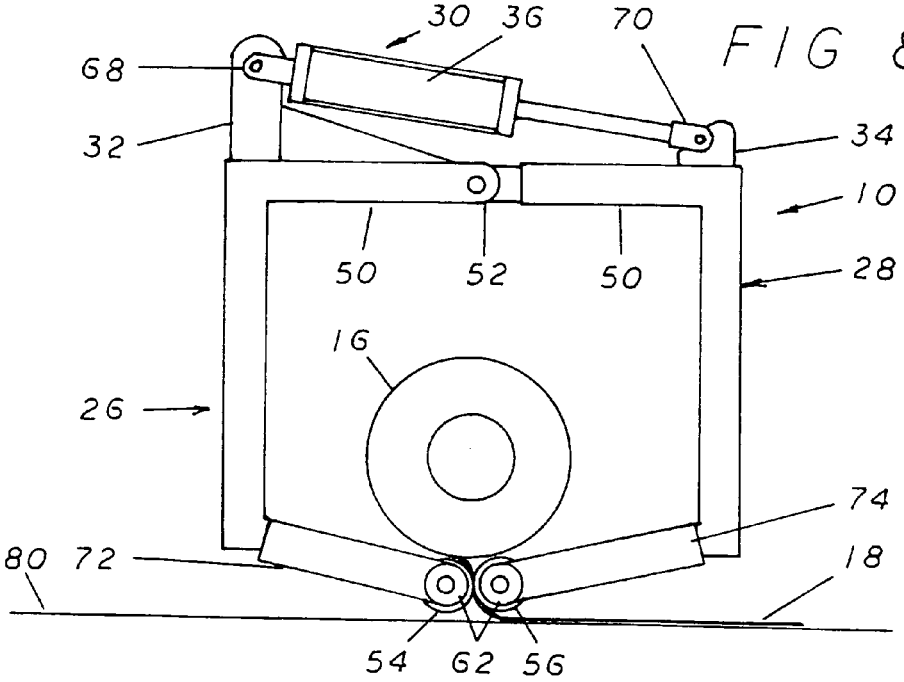
FIG. 8 is a side elevation view of the present invention of FIG. 2 further illustrating the manner by which its frame is closed by the action of the hydraulic assembly to contain a fabric roll and deploy the fabric.

The manner by which the hydraulic assembly is employed to open and close the frame 12 is further detailed in FIGS. 7 and 8. With the hydraulic cylinder 36 fully contracted, the rear mount 32 and the front mount 34 are drawn towards one another. This motion causes the rear frame half 26 and the front frame half 28 to pivot in relation to one another around the frame pivots 52. As previously stated, this pivoting motion results in the rear and front feeder rollers, 54 and 56, moving away from one another creating the frame opening 78 in the lower surface of the invention's frame 12. With the frame 12 in this position, the operator is free to engage a fabric roll 16 laying on the ground 80.

In the engagement of the fabric roll 16 the first step is for the operator to extend a short section of the stabilization fabric 18 out away from the fabric roll 16 over the ground 80. With this accomplished, the present invention is placed over the fabric roll 16 so that it sits within the frame opening 78 (illustrated in FIG. 7) and the rear and front feeder rollers, 54 and 56, being positioned on or just above the surface of the ground 80.

From this position, the hydraulic cylinder 36 can be expanded by the operator within the skid steer loader 14. The expansion causes the rear and front mounts, 32 and 34, to move away from one another which in turn pivots the rear and front frame halves, 26 and 28, back to the positions in which their respective frame pivot arms 50 are in a horizontal orientation. This motion forces the rear and front feeder rollers, 54 and 56, together pinching the fabric roll 16 and lifting it off of the ground 80 to rest on the upper surfaces of the rear and front feeder rollers, 54 and 56, within the interior of the frame 12 (illustrated in FIG. 8). In this process, the section of stabilization fabric 18 that was separated from the fabric roll 16 ends up protruding out of the frame 12 between the rear and front feeder rollers, 54 and 56, and onto the surface of the ground 80.

The circumstance in which the stabilization fabric 18 extends out between the rear and front feeder rollers, 54 and 56, and the ramifications of this on the operation of the present invention are further detailed in FIG. 9. The passage of the stabilization fabric 18 through this area not only allows it to be deployed over the desired area, but facilitates an important aspect of the present invention. As described above, the position of the rear and front feeder rollers, 54 and 56, relative to one another is controlled by the hydraulic cylinder 36. Additionally, the hydraulic cylinder's 36 pressure relief valve 42 allows the operator to vary the amount of pressure placed on the stabilization fabric 18 as it passes between the rear and front feeder rollers, 54 and 56. This is possible due to the pressure relief valve's 42 connection to the hydraulic return line 40 through the pressure relief line 44. This configuration provides a means by which excess pressure in the system may be bled off through the hydraulic return line 40. The importance of this is that by exerting pressure on the stabilization fabric 18 as it passes the present invention, the operator can tailor the tension placed on the fabric 18 to match the requirements of a specific job. This allows one worker using the present invention to deploy stabilization fabric 18 at a job site in a manner that exactly matches the requirements of the conditions which previously required multiple workers to complete successfully.

The manner in which the rear and front feeder rollers, 54 and 56, are attached to the frame 12 is further detailed in FIG. 10. Additionally, this FIGURE depicts this attachment for one end of the rear feeder roller 54 but the attachment is identical for all other attachments as well. The rear feeder roller 54 has on either end a roller axle 64 that extends outwardly on either end. These axles 64 extend into the bearing mounts 76 which contain the roller mount bearings 62 which support the roller axles 64 and in turn, the rear and the front feeder rollers, 54 and 56. The bearing mounts 62 serve to tie these assemblies to the related roller arm, in this case, the rear roller arm 72. The described manner of rotationally attaching the rear and front feeder rollers, 54 and 56, to the frame 12 of the present invention allows them to freely rotate independently from all other components which in turn allows the invention to function as designed.

Although the present invention has been described in considerable detail with reference to certain preferred versions thereof, other versions are possible. Therefore, the spirit and scope of the appended claims should not be limited to the description of the preferred versions contained herein.

What is claimed is:

1. A stabilization fabric application apparatus for mounting on tractor, said application apparatus comprising:

an elongate substantially rectangular shaped frame having a front frame half having an upper portion, a lower portion and front portion, a rear frame half having an upper portion, a lower portion and a rear portion;

a left and right frame pivot on said upper portions of said front and rear frame halves such that said elongate substantially rectangular shape frame can open and close about said pivots;

a front feeder roller spanning the lower portion of said front frame half;

a rear feeder roller spanning the lower portion of said rear frame half such that when said elongate rectangular shaped frame is in a closed position said front and rear feeder rollers contact each other;

a rear mount extending upward from said upper portion of said rear frame half and a front mount extending upward from said upper portion of said front frame half;

a hydraulic cylinder connecting said rear and front mount such that the expansion and contraction of said hydraulic cylinder opens and closes elongate substantially rectangular shaped frame;

a left and right bearing on each of said front and rear feeder rollers; and a pair of accessory chains mounted to said front portion of said front frame for storage of a roll of stabilization fabric.

2. A stabilization fabric application apparatus as in claim 1 wherein the lower portion of said front and rear frame halves form a concave section above said front and rear feeder roller.

3. A stabilization fabric application apparatus as in claim 1 wherein said tractor is a skid steer loader.

4. A stabilization fabric application apparatus as in claim 1 including a frame mount on the rear portion of said frame half for removably attaching said application apparatus to said tractor.

5. A stabilization fabric application apparatus as in claim 1 wherein said left and right bearing of said front feeder roller and said rear feeder roller pivotally attach said front feeder roller to said front frame half and said rear feeder roller to said rear frame half.

6. A stabilization fabric application apparatus as in claim 1 wherein said front and rear feeder rollers being positioned such that when said elongate rectangular shaped frame is in a closed position said front and rear feeder rollers contact each other.

7. A stabilization fabric application apparatus for mounting on tractor, said application apparatus comprising:

a frame including a first frame half and a second frame half, wherein said frame is comprised of an elongated configuration;

wherein said frame is comprised of a substantially hollow configuration and wherein said first frame half and said second frame half define said hollow configuration;

wherein said first frame half and said second frame half each include an upper portion and a lower portion;

wherein said upper portion of said first frame half and said second frame half are pivotally attached to each other to cause said lower portion of said first frame half and said second frame half to move inwardly and outwardly with respect to each other;

a front feeder roller spanning the lower portion of said first frame half, wherein said front feeder roller is rotatably attached with respect to said lower portion of said first frame half;

a rear feeder roller spanning the lower portion of said second frame half, wherein said rear feeder roller is rotatably attached with respect to said lower portion of said second frame half; and a hydraulic cylinder extending between said first frame half and said second frame half.

8. The stabilization fabric application apparatus as in claim 7 wherein said front feeder roller and said rear feeder roller contact each other when said frame is in a closed position.

9. The stabilization fabric application apparatus as in claim 7 wherein said hydraulic cylinder is connected to said first frame half on a first end of said hydraulic cylinder and said second frame half on a second end of said hydraulic cylinder.

10. The stabilization fabric application apparatus as in claim 9 wherein said hydraulic cylinder pivots said first frame half and said second frame half with respect to each other.

11. The stabilization fabric application apparatus as in claim 7 including a pair of accessory chains mounted to said frame for storage of a roll of stabilization fabric.

12. The stabilization fabric application apparatus as in claim 7 wherein said lower portion of said first frame half and said second frame half define an obtuse angle angling downwardly with respect to said frame.

13. The stabilization fabric application apparatus as in claim 7 including a roll of stabilization fabric positioned within said frame to deploy said stabilization fabric out of said frame between said front feeder roller and said rear feeder roller.

14. The stabilization fabric application apparatus as in claim 7 wherein said frame is oriented in a horizontal manner when deploying a roll of material.

15. A stabilization fabric application apparatus for mounting on tractor, said application apparatus comprising:

a frame including a first frame half and a second frame half, wherein said frame is comprised of an elongated configuration;

wherein said frame is comprised of a substantially hollow configuration and wherein said first frame half and said second frame half define said hollow configuration;

wherein said first frame half and said second frame half each include an upper portion and a lower portion;

wherein said upper portion is of said first frame half and said second frame half are pivotally attached to each other to cause said lower portion of said first frame half and said second frame half to move inwardly and outwardly with respect to each other;

a feeder roller spanning the lower portion of said second frame half; and a hydraulic cylinder extending between said first frame half and said second frame half;

wherein said hydraulic cylinder is connected to said first frame half on a first end of said hydraulic cylinder and said second frame half on a second end of said hydraulic cylinder;

wherein said hydraulic cylinder pivots said first frame half and said second frame half with respect to each other.

16. The stabilization fabric application apparatus as in claim 15 wherein said feeder roller is rotatably attached with respect to said second frame half.

17. The stabilization fabric application apparatus as in claim 15 wherein said frame is oriented in a horizontal manner when deploying a roll of material.

18. The stabilization fabric application apparatus as in claim 15 wherein said lower portion of said first frame half and said second frame half define an obtuse angle angling downwardly with respect to said frame.

19. The stabilization fabric application apparatus as in claim 15 wherein said lower portion of said first frame half and said second frame half substantially come in contact with each other when said frame is in a closed position.

* * * * *